United States Patent [19]

Bergmark

[11] Patent Number: 4,564,963

[45] Date of Patent: Jan. 21, 1986

[54] DRYING DEVICE FOR SHOWER SPACE

[76] Inventor: Nils R. Bergmark, Ringvägen 14, S-930 47 Byske, Sweden

[21] Appl. No.: 666,625

[22] PCT Filed: Feb. 7, 1984

[86] PCT No.: PCT/SE84/00037

§ 371 Date: Oct. 5, 1984

§ 102(e) Date: Oct. 5, 1984

[87] PCT Pub. No.: WO84/03030

PCT Pub. Date: Aug. 16, 1984

[30] Foreign Application Priority Data

Feb. 10, 1983 [SE] Sweden ..... 8300715

[51] Int. Cl.[4] ..... A47K 3/22

[52] U.S. Cl. ..... 4/597; 4/605; 4/609; 4/610; 16/224; 16/342

[58] Field of Search ..... 4/546, 555–559, 4/584, 596–597, 604–605, 607–608, 610, 612, 614; 160/135; 211/168–169, 96; 312/135, 252, 305; 108/142; 384/244–246; 248/415, 425; 16/224, 317, 337, 341, 342, 386

[56] References Cited

U.S. PATENT DOCUMENTS

| | | | |
|---|---|---|---|
| 437,016 | 9/1890 | Byrnes | 160/135 |
| 760,140 | 5/1904 | McGinness | 16/341 |
| 790,047 | 5/1905 | Goldman | 211/169 |
| 2,048,909 | 7/1936 | Woodworth | 4/557 |
| 3,000,049 | 9/1961 | Terry, Jr. | 16/386 |
| 3,025,532 | 3/1962 | Skuda | 4/608 |
| 3,188,699 | 6/1965 | Walters | 4/607 |
| 3,722,031 | 3/1973 | Bourgeois | 16/317 |
| 4,186,905 | 2/1980 | Brudy | 16/342 |

FOREIGN PATENT DOCUMENTS

| | | | |
|---|---|---|---|
| 82729 | 5/1903 | Canada . | |
| 260770 | 5/1926 | Canada . | |
| 306912 | 12/1930 | Canada . | |
| 501564 | 4/1954 | Canada . | |
| 2808611 | 9/1978 | Fed. Rep. of Germany . | |
| 618840 | 2/1949 | United Kingdom | 16/342 |

*Primary Examiner*—Stephen Marcus
*Assistant Examiner*—Linda J. Sholl
*Attorney, Agent, or Firm*—Cushman, Darby & Cushman

[57] ABSTRACT

A screen wall of a shower space comprises a wall section in the form of a screen which is pivoted about its vertical center line. The screen (2) is provided on one side with bow-shaped bars (8) for hanging articles for drying and can be rotated at least 180° about its vertical center line. The flat side of the screen can thus face the shower space when it is used for showering. When articles have been hanged on the bars (8) for drying, the screen can be swung 180° placing the bars and the articles inside the shower space where they can drip and are no longer visible from outside the shower space.

7 Claims, 4 Drawing Figures

DRYING DEVICE FOR SHOWER SPACE

In apartments especially, the space above the bathtub is often used for hanging up laundry to dry. A disadvantage of this is that the clothes block the bathtub during the entire drying process, especially if the bathtub is also used as a shower space. The problem is solved according to the invention with a combined drying device and shower screen as specified in the attached main claim.

The pivoting screen in the shower screen wall according to the invention is made water-repellent on one side, for example as a conventional screen for a shower space. On the other side, the pivoting screen is provided with hangers for laundry. When the shower space, which can be the space above a bathtub, is to be used for showering, the screen is rotated so that its water-repellent side faces the shower space. At other times, the screen can be swung so that its side provided with hangers faces the shower space. The laundry will then not clutter up the rest of the space in the bathroom and will not be visible either, which is an esthetic advantage.

Previously known screen walls for shower spaces have not permitted effective use as a drying device for laundry. Divisions in the form of sliding doors or swinging doors are known, which are provided with a bar or the like for hanging a towel. The doors can not, however, be reversed so that the hanging device faces the shower space when the space is not used for showering and at the same time keeping the hanging laundry out of sight from other spaces (U.S. Pat. No. 2,851,695, DE-OS No. 2 902 550).

The water-repellent side of the screen can be made as a stiff sheet or alternatively as a cloth which is tensioned in a frame. In the latter case, according to a further development of the invention, the hanger bars for drying articles are formed of horizontal bows tensioned between the lateral frame edges of the screen in such a manner as to press the edges apart and thereby stretch the cloth.

Figure 2:
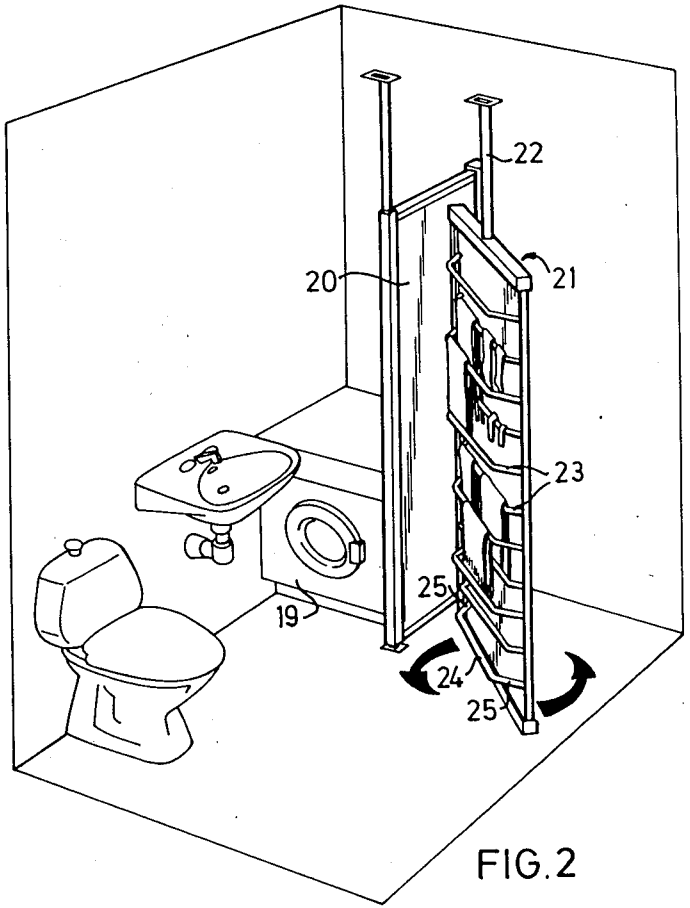
Figure 1:
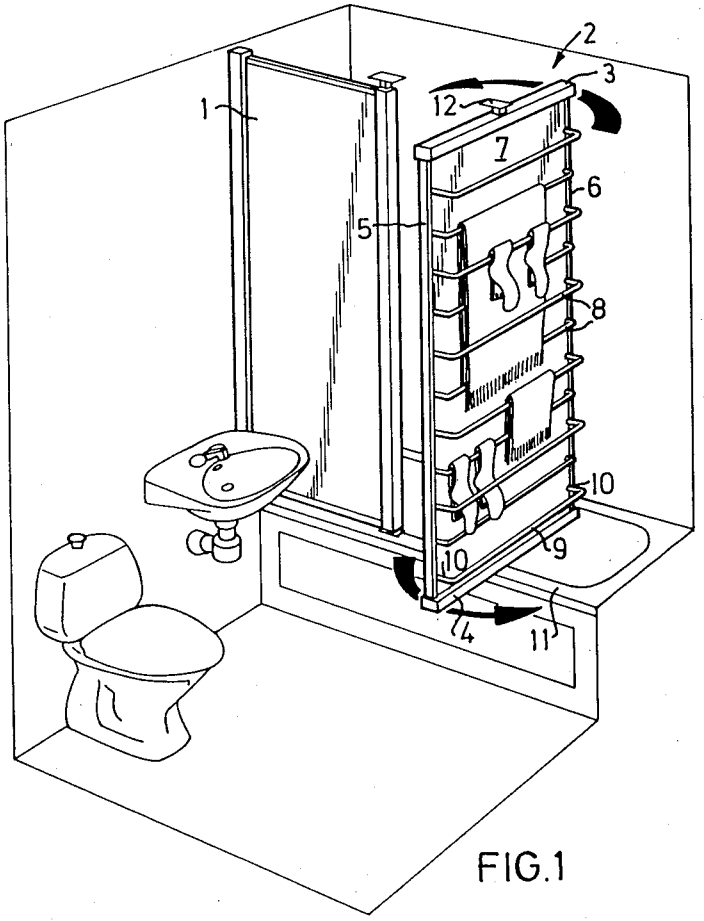
Figure 4:
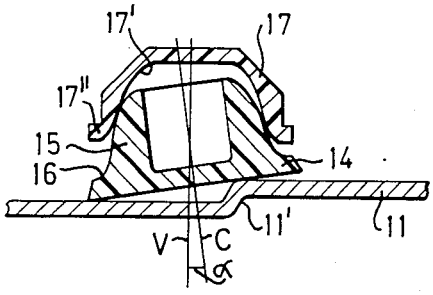
Figure 3:
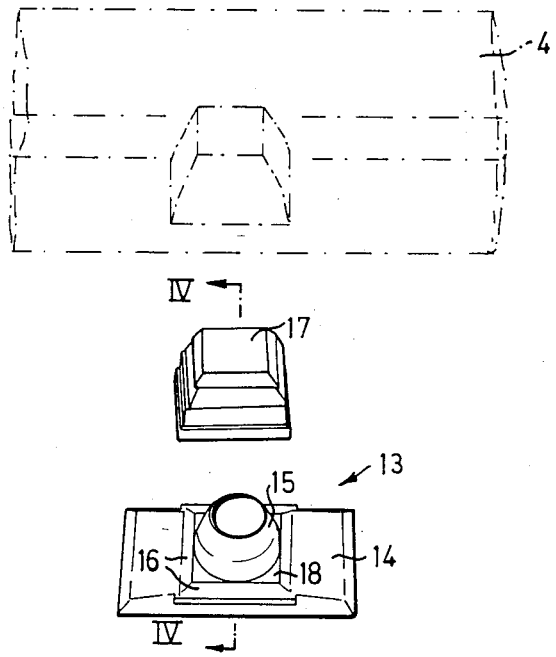

An example of the invention is described below in more detail with reference to the accompanying drawings, of which FIG. 1 shows schematically a bathroom with a screen wall according to the invention mounted on the edge of the bathtub, FIG. 2 shows in a corresponding manner how a screen wall according to the invention is used to define a shower space which has been arranged instead of the bathtub, FIG. 3 shows an exploded sketch of the lower pivot bearing for the screen, and FIG. 4 shows a section along the line IV—IV in FIG. 3.

FIG. 1 shows schematically a bathroom in which a screen wall has been mounted between the edge of the bathtub and the ceiling. The screen wall consists of a fixed wall section 1 and a wall section 2 which pivots about its vertical center line. The pivoting wall section or screen 2 consists of a frame comprising upper and lower horizontal profiled bars 3 and 4 respectively, preferably made as square tubes. The vertical lateral edges of the screen 2 are formed of posts 5,6 which can also be made of square tubes. The four profiled bars 3–6 form a frame in which a water-repellent cloth 7 is stretched. On one side of the screen, a number of hanger bars for drying articles are arranged in the form of horizontal bows 8 of thick wire placed at various levels. As can be seen in FIG. 1, the bows 8 have an elongated straight portion 9, which is substantially as long as the width of the screen 2. This portion 9 is connected to end portions 10, bent at an angle thereto and the ends of which are fixed in a suitable manner to the lateral edge bars 5,6 of the frame 2. The length of the bow portion 9 which is parallel to the frame 2, and the angle between said portion 9 and the bow end portions 10 is chosen so that the distance between the free ends of end portions 10 is greater than the distance between the lateral edge posts 5,6 before the bows are mounted in place. When the bows 9 are then mounted between the lateral edges 5,6, they exert a force which pushes the side edges 5,6 away from each other, thereby keeping the cloth 7 under tension.

The screen 2 is unlimitedly rotatable about its vertical center line. This is achieved by virtue of the fact that its upper and lower frame profiled bars 3,4 are rotatably joined to the bathroom ceiling and bathtub edge 11 respectively. The ceiling fitting 12 is not shown in more detail here, but can consist for example of a sleeve fixed in the ceiling and a pin which fits into the sleeve and which is fixed to the middle of the upper edge bar 3. The lower pivot mounting is not shown in FIG. 1 but is shown in detail in FIGS. 3 and 4. This lower mounting 13 consists of a bottom plate 14 which is designed to be fixed to the edge 11 of the bathtub in a suitable manner, for example by gluing. The base plate 14 has a central bearing portion in the form of an upright ball pivot 15. This is surrounded by inclined bevelled edge portions 16, which form the sides of a square. Furthermore, the lower mounting 13 comprises an upper, movable portion 17 which is made as a ball cup which is square in vertical projection and which is designed to be inserted into a special cavity in the lower frame bar 4 of the screen 2. The ball cup 17 has an interior bearing surface 17' which fits the ball pivot 15 of the base plate 14. The lower edges 17'' of the ball cup 17 are internally bevelled so that they fit the bevelled edges 16 of the base plate 14. When the ball cup 17 rests on the base plate 14 with its edges parallel to the edges of the base plate 14, both the ball pivot 15 and the bevelled edges 16 of the base plate will be in contact with corresponding complementary surfaces 17',17'' in the ball cup 17. If the ball cup 17 is turned about the ball pivot 15 axis for one of these four positions, the ball cup 17 will ride up on the bevelled edges 16 so that the lower edge 17'' of the ball cup 17 will rest on the corners 18 which are at a higher level between the ball pivot 15 and the edges 16 of the base plate 14. The ball cup 17, and thus the entire screen 2, has thereby been lifted up a distance corresponding to the height of the bevelled edge 16. This arrangement provides the screen 2 with four stable rest positions, namely two parallel with the bathtub edge and two perpendicular thereto.

As can be seen in FIG. 4, the screen 2 will have four stable rest positions even if the base plate 14 of the lower mounting should be mounted on such an underlying surface that its center axis C is not vertical, but forms an angle $\alpha$ with the vertical center line V through the ball cup 17. FIG. 4 shows the base plate 14 mounted over the ridge 11' on the edge 11 of the bathtub. The angle $\alpha$ can be as much as ca 30° without breaking the bearing of the ball cup 17 on the ball pivot 15, and preserving the positions of the four stable rest positions, and their 90° spacing. Only one pair of bevelled surfaces 16/17' interact at a time when the center axis C of the base plate 14 is not vertical, but this is quite sufficient to hold the screen 2 in the rest positions.

When the screen 2 is to permit stepping into and out of the bathtub, it is turned perpendicular to the edge of the bathtub. When the bathtub is used for showering, the screen is turned parallel to the edge of the bathtub with its flat side without hanger bars facing inwards towards the bathtub. This pivot position is also used when laundry is to be hung on the hanger bars 8, which at that time face out towards the bathroom. When the articles to be dried have been hung on the hanger side 8, the screen is rotated 180° so that its flat side faces out towards the bathroom and the bars 8 with the drying articles are located over the bathtub. Any water dropping from the laundry will be caught in the bathtub at the same time as the bathroom has a neater appearance by concealing the hanging laundry.

FIG. 2 shows another embodiment of the screen shown in FIG. 1.

As in FIG. 1, FIG. 2 shows schematically a bathroom in which the bathtub has, however, been removed. In its place are a washing machine 19 and a shower space which is formed by a fixed wall section 20 and a rotatable wall section or screen 21. As does the screen 2 in FIG. 1, the screen 21 pivots about its vertical center line and is rotatably fixed between the bathroom ceiling and floor. The ceiling mounting 22 is made in the same manner as the ceiling mounting 12 in FIG. 1, but has a tubular elongated sleeve fixed to the ceiling. The lower pivot mounting for the screen 21 is made in the same manner as the mounting 13 shown in FIG. 3. The two wall sections 20,21 form a so-called shower corner. If the space next to the fixed wall section 20 is free, it can alternatively be replaced by a second rotatable screen corresponding to the screen 21. They can then both be rotated about their vertical center lines and provide a broad entrance opening in the corner and twice the length of hanger bars for the articles to be dried. For such a corner arrangement, it is suitable that the hanger bars be made in the manner shown in FIG. 2. The hanger bars are in this case bows 23 made of thick wire similar to the hanger bars 8 in FIG. 1. The bows 23 are made, however, with a horizontal portion 24 running parallel to the screen 21 which is shorter than the distance between the vertical lateral edges of the screen 21. The end pieces 25 connecting thereto form an angle of substantially 45° with the central bow portion 24. This shape of the bows 23 allows two rotatable screens made at the screen 21 in FIG. 2, to be arranged at right angles to each other without the corners of the bows in the two screens hitting each other.

The invention is not limited to the example described above and shown in the drawings. Instead of a cloth stretched in a frame, the water-repellent surface of the screen can, as an alternative, be a rigid sheet. Other types of hanger means for drying articles than the bows shown are also conceivable. The pivot bearing of the screen can also be made in a number of ways. An alternative to the upper mounting shown is an upper mounting formed of a sleeve fixed in the ceiling, a sleeve fixed to the upper edge bar of the screen, and a pipe inserted in the sleeves, which is cut to the desired length for the installation in question.

I claim:

1. A wall section in the form of a splash-proof water repellent screen wall for a shower space, said wall section being provided on one side with hanging means for drying laundry, characterized in that the wall section is formed of a screen rotatable at least substantially 180° about a vertical axis at its center such that said hanging means is positioned outside said shower space when the shower space is in use and such that the hanging means is positioned within the shower space to obsure the drying laundry from view when the hanging means is to be used as a drying rack; and that the hanging means comprise a plurality of hanger bars disposed at different levels, for articles, such as clothing, to be dried.

2. Wall section according to claim 1, characterized in that the screen is unlimitedly rotatable about its vertical center line.

3. Wall section according to claim 1, characterized in that a rotatable bearing of the screen has rest positions at predetermined angular positions of the screen.

4. Wall section according to claim 3, characterized in that the bearing comprises, firstly, a lower base plate, which is provided with an upright ball pivot surrounded by, bevelled edges arranged in a square; and, secondly, a ball cup mounted on the ball pivot, the lower edge of said ball cup interacting with said bevelled edges to form said rest positions.

5. Wall section according to claim 1, characterized in that the screen comprises a frame, which forms horizontal and vertical edges, and a water-repellent cloth stretched on the frame; and that the hanger bars for drying articles are formed of horizontally disposed bows tensioned between the lateral edges of the screen in such a manner as to press the edges apart and thereby stretch the cloth.

6. Wall section according to claim 5, characterized in that each of said bows comprises a middle portion parallel to the screen and end portions forming approximately 45° angles with said middle portion.

7. A wall section as a splash-proof screen wall for a shower space, said wall section having one side made of a water-repellent material and the opposite side having a plurality of drying racks for articles, the wall section being mounted on a bearing and capable of rotating 180° about a vertical axis in the center of said wall section whereby said side having a water repellent material is positioned within the shower space when the shower space is in use, and said side having the drying racks is positioned within the shower space when the shower space is not in use, the bearing comprising a lower base plate having an upright ball pivot, the base plate having bevelled edges surrounding said ball pivot, the ball pivot being received in a ball cup mounted on the lower portion of the wall section, the ball cup having its lower edges interacting with said bevelled edges to form rest positions.

* * * * *